United States Patent [19]

DeLuca

[11] 4,323,214

[45] Apr. 6, 1982

[54] BOOK READING REST

[76] Inventor: Nicholas E. DeLuca, 125 Susan Dr., Pittsburgh, Pa. 15220

[21] Appl. No.: 170,524

[22] Filed: Jul. 21, 1980

[51] Int. Cl.[3] ..... A47B 97/04

[52] U.S. Cl. ..... 248/452; 248/456; 248/461

[58] Field of Search ..... 248/447, 451, 452, 453, 248/454, 455, 456, 461, 463, 465; 312/231

[56] References Cited

U.S. PATENT DOCUMENTS

| | | | |
|---|---|---|---|
| 395,715 | 1/1889 | Nichols | 248/453 |
| 451,603 | 5/1891 | Sterry | 292/251.5 |
| 864,066 | 8/1907 | Berwick . | |
| 1,069,617 | 8/1913 | Ilvonen . | |
| 1,203,659 | 11/1916 | Smith | 248/456 |
| 1,320,322 | 10/1919 | Delong . | |
| 2,019,581 | 11/1935 | Probst | 248/447 |
| 2,156,489 | 5/1939 | Bonetti | 248/461 |
| 2,211,660 | 8/1940 | Kidd et al. | 312/231 |
| 2,453,021 | 11/1948 | Konelsky | 292/251.5 X |
| 2,474,532 | 6/1949 | Kitchen . | |
| 2,481,264 | 9/1949 | Tulowiecki . | |
| 2,489,154 | 11/1949 | Relton | 292/251.5 |
| 2,935,812 | 5/1960 | Adami . | |
| 3,031,247 | 4/1962 | Schieve . | |
| 3,073,057 | 1/1963 | Farber . | |
| 3,168,363 | 2/1965 | Monsour . | |
| 3,311,202 | 3/1967 | Schell et al. . | |
| 3,424,283 | 1/1969 | Sheldon . | |
| 3,669,227 | 6/1972 | Alford | 248/447 |
| 3,773,154 | 11/1973 | Mitchell . | |

FOREIGN PATENT DOCUMENTS

| | | | |
|---|---|---|---|
| 231102 | 5/1963 | Austria | 248/451 |

*Primary Examiner*—J. Franklin Foss

*Attorney, Agent, or Firm*—Buell, Blenko, Ziesenheim & Beck

[57] ABSTRACT

The specification discloses a folding book reading rest comprising a pair of box sections hingedly connected together and movable between open and closed position. A book rest member is foldable out of each box section to provide a tilting surface. Also provided are shelf means, page restraining means and telescoping extensions for the book rest members.

4 Claims, 3 Drawing Figures

BOOK READING REST

The invention relates to devices for supporting books, magazines, and the like for reading. It is particularly useful for holding upright large books which either are so tightly bound or have so many pages that they tend to close if laid on an inclined surface.

Various reading rest devices have long been used to hold books, papers, and the like at an inclined position; see, e.g., U.S. Pat. No. 1,203,659, issued Nov. 7, 1916, to S. T. Smith. A problem of such devices is that they do not provide a way to hold down the pages of a thick book or to hold all except several pages for easy reference back and forth between adjacent pages.

I provide a reading device which holds a book and presents the open pages as a substantially flat surface. When not in use, the device folds into a compact carrying case. I provide two open box sections, each having a flat bottom and four upright sides. Each box section has a side disposed adjacent a side of the other. Hinge means attached to the adjacent side walls connect the two box sections in folding relationship. I further provide a rest member in each box section. Each rest member is pivotally connected at one end of the associated box section and may be positioned within the box section or rotated to project above the box section. I further provide prop means to hold the rest members in desired sloping relationship to the box sections. I may also provide shelf means projecting from the rest members and page restraining means associated therewith. I further prefer to provide extensions for the rest members.

Other details, objects and advantages of the invention will become more apparent as the following description of a presently preferred embodiment thereof proceeds.

In the accompanying drawings, I have shown a presently preferred embodiment of the invention in which.

Figure 1:
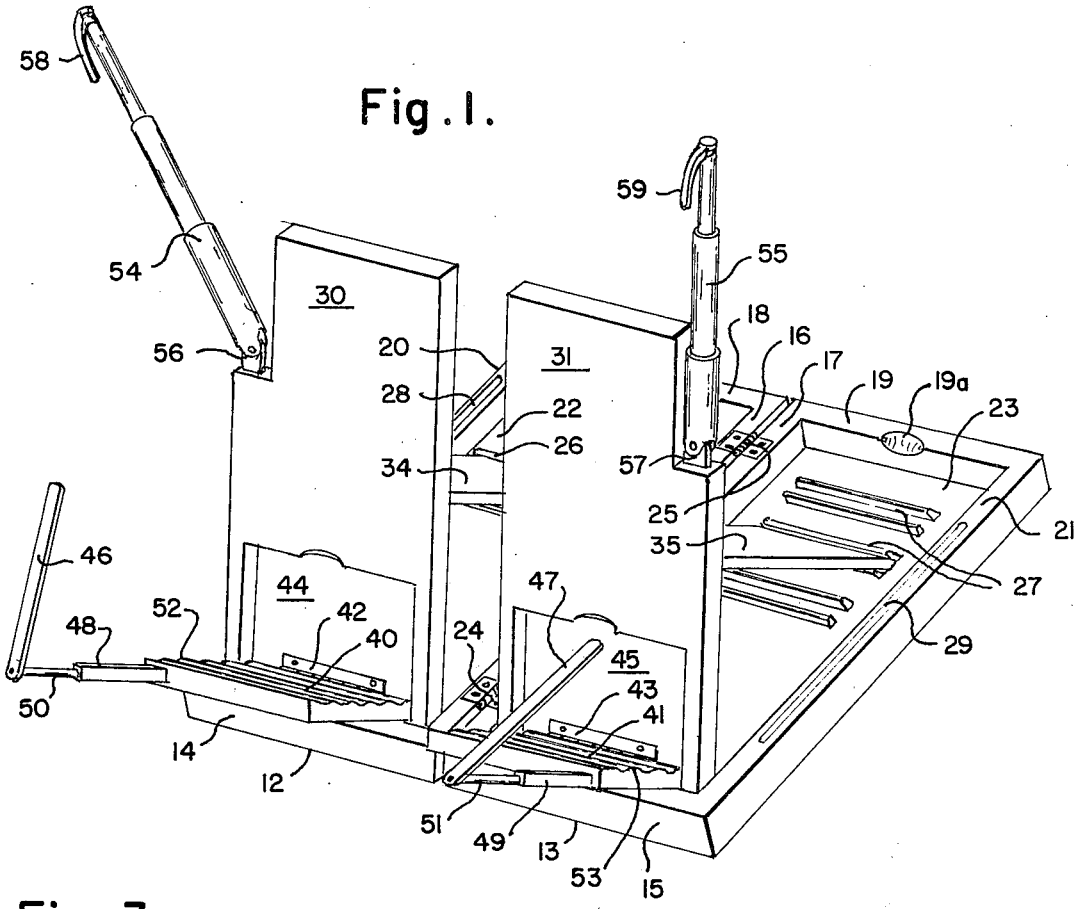
FIG. 1 is a perspective view of a reading rest device embodying my invention.

The reading rest is shown in open position. A left box section 12 and a right box section 13 may be placed on a table or other surface. The left box section 12 has four walls, including a front wall 14, an intermediate side wall 16, a back wall 18, and an outer side wall 20, extending upwardly from bottom section 22. Similarly, the right box section 13 has a front wall 15, an intermediate side wall 17, a back wall 19 and an outer side wall 21 extending upwardly from a bottom section 23. The left box section 12 is pivotally connected to the right box section 13 by a front hinge 24 and a back hinge 25 attached to the adjacent side walls 16 and 17. The outer walls 20 and 21 have closure magnets 28 and 29 respectively embedded in the upper surfaces which attach each other when box sections 12 and 13 are folded face-to-face on hinge 24 and 25.

A right back rest member 31 is pivotally connected to right intermediate side wall 17 and to right outer side wall 21 of the right box section 13 by a pin 33. A prop member 35 is pivotally connected to the rest member 31 by a pin 37. Prop member 35 is rotated from a recess 39 downwardly and adjusted to engage one of several projections 27 formed within box section 13 for supporting the back rest member 31. Similarly, a left rest member 30 is pivotally connected to the left box section side walls 16 and 20 by a pin 32 disposed along an axis in common with pin 33. A left prop member 34 is pivotally connected to the left rest member 30 by a pin 36 for rotation from a recess 38 in the left rest member 30 downwardly for engagement with projections 26 in left box section 12 to support the left rest member 30.

Right rest member 31 has a shelf 41 pivotally attached to right rest member 31 by a hinge 43. Shelf 41 rotates from a recess 45 in right rest member 31 to extend over the front wall 15 substantially perpendicular to rest member 31. Similarly, a left shelf 40 is pivotally connected to left rest member 30 by a hinge 42 and rotates from a recess 44 in the left rest member 30 to extend over front wall 14 substantially perpendicular to rest member 30. A finger recess **19*a* is provided in back wall 19 and a similar recess is provided in back wall 18 to facilitate opening and raising of rest members 30 and 31. Shelves 40 and 41 have pivotally connected arms 46 and 47 which are rotatable about pins 50 and 51 in a plane substantially parallel to the plane of the back rest members 30 and 31. Arms 46 and 47 are connected to telescoping extensions 48 and 49 which extend from shelves 40 and 41. Telescoping extensions 48 and 49 provide auxiliary means for supporting very thick boots on a shelf support 40 and 41 which must be small enough to fit into recesses such as 44 and 45. Shelves 40 and 41 also may have ridges 52 and 53** on their upper surfaces for holding the pages of the book in place.

Telescoping extensions 54 and 55 are mounted in recesses within rest members 30 and 31. They may be extended by pulling upwardly to support tall books. They may be collapsed when they are not in use. Extensions 54 and 55 are mounted on swivels 56 and 57, respectively, to enable the corners of wide books to be grasped. Hooks 58 and 59 are fitted to the free ends of extensions 54 and 55 respectively to grasp the pages.

The book reading rest may be folded into a compact case by rotating arms 46 and 47 and collapsing extensions 48 and 49 until arms 46 and 47 are in juxtaposition to shelves 40 and 41. Shelves 40 and 41 are then folded into recesses 44 and 45. Extensions 54 and 55 are likewise collapsed into rest members 30 and 31. Prop means 34 and 35 are rotated about the axes of pins 36 and 37 until they are positioned within recesses 38 and 39, thereby permitting rest members 30 and 31 to lay flat within box sections 12 and 13. Box sections 12 and 13 are then folded together on hinges 24 and 25 until magnets 28 and 29 come into contact. The book reading rest is then reduced to a compact case with a smooth outer surfaces which can be conveniently placed in a pocket or purse.

Figure 3:
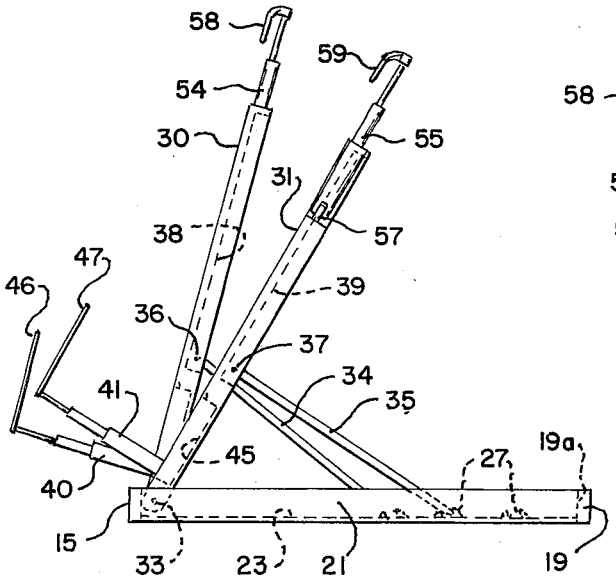
FIG. 3 is a side elevational view of the reading rest device illustrated in FIG. 1, with one rest member shown at a steeper inclination than that of FIG. 1.
Figure 2:
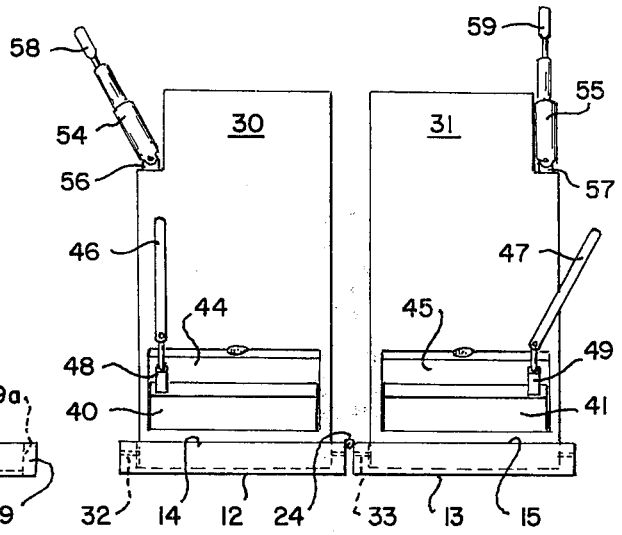
FIG. 2 is a front elevational view of the reading device illustrated in FIG. 1.

To place the book rest in use the two box sections are opened and placed with bottom sections 22 and 23 on a flat surface. Rest members 30 and 31 are pulled upwardly about box sections 12 and 13 rotating on pins 36 and 37. Prop means 34 and 35 are caused to rotate out of their recess about pins 36 and 37 respectively and are adjusted to engage the desired projections 26 and 27. Shelves 40 and 41 are rotated from their recesses on hinges 42 and 43 to extend on the front walls 14 and 15. As the device is illustrated in FIG. 3, a large book to be opened to the first pages would be placed on the right rest means at the desired inclination and supported on its back cover and bottom edge. A very large book may be additionally supported by the extended telescoping members 49 and 55. The left rest member 30 could, for example, be inclined at a steeper angle relative to the bottom sections 22 and 23. The top portion of the book front cover is supported by the rest member 30 at about the thickness of the book in front of the rear cover. The pages of the book are restrained from movement by pivotal arms 46 and 47 which project upwardly in front of the book. Also ridges 52 and 53 in shelves 40 and 41 tend to restrain the movement of the pages. By adjustment of prop members 34 and 35, the angle at which the book rests may be changed. Where it is desired to leaf back and forth through several consecutive pages, they may be left free between arms 46 and 47. Arms 46 and 47 may be turned down to permit easy turning of the pages and then returned to upright position where they hold the pages for further reading.

While I have shown and described a present preferred embodiment of my invention, it is to be understood that the invention is not limited thereto, but may be otherwise variously practiced within the scope of the following claims.

I claim:

1. A reading rest device for presenting the open pages of a book as a substantially flat surface comprising:

two rectangular box sections, each section having a flat bottom and four upright sides, said box sections being arranged with an edge of one in juxtaposition to an edge of the other;

hinge means connecting said adjacent edges whereby the box sections may be rotated relatively between an open position and a closed position in which the openings of the box sections are facing to form a closed box;

separate rest means pivotally connected to the box sections in substantially side-by-side relationship, one rest means being associated with each box section;

prop means extending between the rest means and box sections for adjustable sloping the rest means;

shelf means extending from each rest means adjacent the pivotal axis thereof and being foldable into a recess in the associated rest means;

rest means pivotally connected by an axially telescoping member to the shelf means associated with each rest member for rotation in a plane substantially parallel to the plane of the rest member whereby the pages of a book may be restrained from turning with adjustment for thickness of the pages; and telescoping arm means associated with each rest member and extensible in the plane of the rest member whereby the effective size of the rest member may be increased to accomodate books of larger size.

2. The reading rest device of claim 1 in which the prop means engage projections from the bottom wall of the associated box section.

3. The reading rest device of claim 1 in which the box sections are held in closed face-to-face relationship by magnet means positioned in the side walls opposite to the hinge means.

4. The reading rest device of claim 1 in which page restraining means are provided in spaced relationship from the rest means.

* * * * *